United States Patent [19]

Toepelt

[11] 4,069,555

[45] Jan. 24, 1978

[54] AUTOMATICALLY LOCKING SECURITY SLIDER FASTENER

[75] Inventor: Werner Toepelt, Old Greenwich, Conn.

[73] Assignee: Coats & Clark, Inc., Stamford, Conn.

[21] Appl. No.: 764,057

[22] Filed: Jan. 31, 1977

[51] Int. Cl.[2] ..... A44B 19/30

[52] U.S. Cl. ..... 24/205.14 R; 70/68

[58] Field of Search ..... 24/205.14 R, 205.14 R, 24/205.14 A; 70/68

[56] References Cited

U.S. PATENT DOCUMENTS

| | | | |
|---|---|---|---|
| 1,919,966 | 7/1933 | Taylor | 24/205.14 A |
| 2,521,453 | 9/1950 | Disinger | 24/205.14 R |

*Primary Examiner*—Bernard A. Gelak

*Attorney, Agent, or Firm*—Burgess, Ryan and Wayne

[57] ABSTRACT

A slider which automatically locks in any desired position on a pair of stringers to which it is attached, which can be moved in either direction by moving its pull, and which may be locked for security purposes by means of a small padlock. A yoke is pivotally mounted on the slider body and has a portion extending through a hole in the slider body to lockably engage the stringers. The pull has a cross bar which engages a cam surface of the yoke to unlock the same from the stringers when the pull is moved. A protuberance on the slider body has a transverse hole situated above a portion of the yoke, so that the padlock inserted through the hole prevents movement of the yoke out of locking engagement with the stringers.

3 Claims, 3 Drawing Figures

AUTOMATICALLY LOCKING SECURITY SLIDER FASTENER

This invention relates to an automatically locking security slider for use in a slide fastener, i.e. to a slider which automatically locks in any desired position on the stringers to which it may be attached, which may be moved along said stringers by moving the pull of the slider, and which may be locked against such movement for security purposes by means of a padlock or similar locking device.

In the slide fastener art, it is well known to provide a manual locking mechanism, i.e. such that after the slider has been moved to a desired position on the stringers to which it is attached, it may be locked against movement from that position. Generally, such locking action is achieved by means of two projections or detents, which can be moved into and out of engagement with the stringers, one projection or detent engaging each stringer. In many of the prior art locking sliders of this type, the projections or detents were provided as an integral part of the pull of the slider.

It is also known from the prior art to provide a locking slider with an automatic locking feature. This is normally accomplished by providing a spring means which urges a member having the aforementioned detents or projections thereon into such a position that the detents or projections are normally in locking engagement with the stringers to which the slider is attached. The mechanism is arranged so that, by squeezing a part of the slider against the slider body, or by moving the pull of the slider, the detents or projections are moved out of locking engagement with the stringers against the action of the spring means, and after the slider has been moved to a new position and the pull released (or the pressure of the actuating part against the slider body has been released), the spring means again urges the projections or detents into locking engagement with the stringers.

Prior art arrangements for enabling the slider of a slide fastener to be locked in a desired position for security purposes, by means of a padlock or the like, are also known.

Locking sliders, of both the manual locking and automatic locking type, are exemplified by U.S. Pat. Nos. 1,833,689; 2,244,743; 2,256,680; 2,261,133; 2,270,221; 2,277,978; 2,520,496; 2,634,486; and 3,292,224.

Various security locking arrangements for a slider of the manually lockable type, or the conventional non-lockable type, are shown in U.S. Pat. Nos. 1,598,183; 1,680,652; 2,569,076; and 3,335,586.

U.S. Pat. No. 2,521,453 to Disinger et al. shows an automatic slider the mechanism of which has some features which are similar to the automatic locking portion of the mechanism to which the present invention relates. In the Disinger et al slider, a locking member L is pivotally mounted to a slider body S by means of a pivot pin 84. The tail portion of the locking member L has two projections or detents 56, 58 which are urged into locking engagement with the stringers to which the slider is attached by the spring action of the rear resilient arms 50, 52 of the locking member L. The inside portion of the locking member L has cam shaped openings 66 and 68 for receiving corresponding prongs of a pull 74. Thus, when no pulling or moving force is applied to the pull 74, the slider is locked in position on the stringers to which it is attached, due to the engagement of the stringers by the detents 56, 58 resulting from the spring action of the locking member arms 50, 52. When a moving force is applied to the pull 74, the prongs 70, 72 of the pull engage the cam shaped openings 66, 68 of the locking member L to pivot the locking member so that the detents are moved away from the stringers, thus unlocking the slider and allowing it to be moved along the stringers.

However, the Disinger et al slider does not have any facility for locking by means of a padlock or the like for security purposes. The locking mechanisms described in the aforementioned patents relating to padlock arrangements are generally complex, cumbersome, or unsuitable for use with an automatic locking slider of the general type shown in Disinger et al.

A relatively simple arrangement for providing a security locking feature on a slider of the manually lockable type is shown in U.S. Pat. No. 1,919,966 to Taylor. The Taylor arrangement involves a slider of the so-called pin locking type, wherein the locking projections or detents are formed as an integral part of the pull of the slider. In the Taylor arrangement, the slider body is provided with a rib-like part 7 having a hole 14 therein through which a padlock may be inserted. The hole 14 is disposed so that the pull 6 of the slider may be rotated to a position against the slider body to manually lock the slider in position by means of a projection 5 formed at the end of the pull 6. The padlock is then inserted through the hole 14 and prevents the pull 6 from being rotated away from the slider body to unlock the slider from the stringers to which it is attached.

The Taylor arrangement, however, is limited to a slider of the manually lockable type, and there is no suggestion in Taylor as to how his security locking arrangement could be adapted to use with a slider of the automatically lockable type, such as that shown in Disinger et al.

Thus, in the prior art, as exemplified by the Disinger et al and Taylor references, it is known to provide an automatically lockable slider of the type employing a locking member pivotally mounted on the slider body and a pull having prongs for engaging a cam surface of the locking member, said locking member being normally urged into locking engagement with the stringers to which the slider is attached by spring means and being disengaged when desired by movement of the pull so that the prongs of the pull engage the cam surface of the locking member to pivot the locking member out of locking engagement with said stringers. It is also known to provide a slider of the manually lockable type with a security locking arrangement utilizing a single rib extending from the slider body and having a hole therein for receiving a padlock.

However, there is need for an automatically lockable slider having a security locking arrangement integral therewith.

Accordingly, an object of the present invention is to provide an automatically lockable slider having a security locking capability integral therewith.

As herein described there is provided an automatically locking security slider for use in a slide fastener including a pair of stringers having mutually interengageable rows of teeth, said slider serving to engage and disengage the same, comprising:

a slider body having a fastener portion for engaging said stringers when said body is pulled in one direction, and for disengaging said stringers when said body is pulled in the opposite direction, said slider body having first and second protuberances extending therefrom, said protuberances being longitudinally spaced apart on said body in the direction of movement thereof, each of said protuberances having an aperture therein extending in a line transverse to said direction of movement;

a yoke disposed adjacent said slide body, said yoke having a bifurcated end part with the bifurcations thereof disposed on opposite sides of said second protuberance;

a transverse pivot pin passing through the aperture of said first protuberance to rotatably mount said yoke to said slider body at said first protuberance;

spring means for urging said end part of said yoke into said slider body, said end part having a tooth-engaging locking projection on each bifurcation thereof so that when urged against said stringers by said spring means said projections engage the teeth of respective ones of said stringers to prevent said slider body from moving with respect thereto, a pull for said slider body, said pull having a transverse crossbar member at least partially extending between said yoke and said slider body between said protuberances, so that when a pulling force is applied to said pull said crossbar member moves against said yoke to cause said yoke to rotate about said pivot pin against the urging of said spring means, moving said projections out of locking engagement with said teeth of said stringers and permitting movement of said slider with respect to said stringers, said end part of said yoke being disposed in such relationship to said aperture of said second protuberance so that a padlock or the like having a locking bar passing through said aperture of said second protuberance may restrain said yoke so that movement of the projections thereof out of locking engagement with the teeth of said stringers is thereby prevented.

The present invention will be best understood by reading the following description in conjunction with the accompanying drawings, in which.

Figure 1:
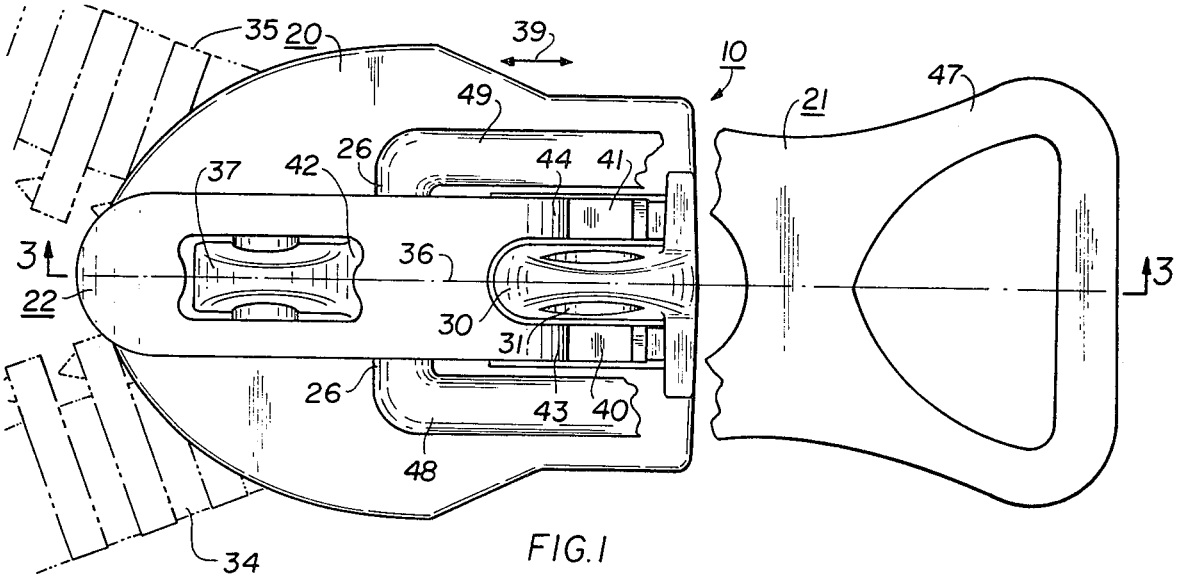
FIG. 1 shows a top view of an automatically locking security slider according to a preferred embodiment of the present invention.

As shown in the drawings, a slider 10 comprises a slider body 20, pull 21 and yoke 22. The slider body 20 has a body portion comprising a top wing 27 and a bottom wing 28 joined by a connecting neck or bow part 29. The top wing 27 has oppositely disposed in-turned side flanges 32, while the bottom wing 28 has oppositely dispoed in-turned side flanges 33, the side flanges 32 and 33 cooperating to define a Y-shaped slide channel for receiving the stringers 34 and 35.

Disposed on the center line 36 of the slider body 20 and extending upwardly from the top wing 27 thereof adjacent a neck 29 is a first protuberance 37. The protuberance 37 has a transverse hole 38 therein.

Disposed on the center line 36 of the slider body 20 and extending upwardly from the top wing 27 thereof, and being longitudinally spaced apart from the first protuberance 37 in the direction of movement indicated by the double arrow 39 of FIG. 1, is a second protuberance 30. The protuberance 30 has a transverse hole 31 therein. The top wing 27 of the slider body 20 has holes 40, 41 therein on opposite sides of the second protuberance 30.

A yoke 22 has a forward slot 42 therein and a bifurcated tail portion having legs 43 and 44. The yoke 22 is disposed adjacent the slider body 20 with the first protuberance 37 extending through the slot 42, and the legs 43 and 44 extending on opposite sides of the second protuberance 30. The yoke 22 is pivotally mounted to the slider body by means of a pivot pin 24 extending across the slot 42 between the opposite walls of the yoke, the pivot pin 24 also extending through the hole 38 in the first protuberance 37. A spring 23 disposed between the top wing 27 of the slider body 20 and the forward portion of the yoke 22 near the neck 29, urges the forward part of the yoke 22 away from the top wing 27, thus causing the yoke 22 to pivot so that the legs 43 and 44 thereof extend into the slider body through the holes 40 and 41.

Each of the legs 43 and 44 of the yoke 22 has a projection or detent 25, 26 at the lower end thereof, so that due to the pivoting action of the yoke 22 caused by the urging of the spring 23, the detents or projections 25 and 26 are caused to engage the stringers 34, 35 to lock the slider 10 against movement with respect to said stringers.

The tail portion of the yoke 22 has a shoulder portion 45 which may engage the lip 46 of the holes 40, 41 adjacent the rearward portion of the protuberance 30 to limit upward pivoting movement of said tail portion. The height L of the tail portion of the yoke 22 is such that when the entire tail portion lies below the hole 31, i.e. between the hole 31 and the bottom wing 28 of the slider body 20, the detents or projections 25, 26 are in locking engagement with the stringers 24, 35, preventing movement of the slider 10 with respect to said stringers. Thus a padlock or similar device may be employed to lock the slider 10 in position with respect to the stringers 34 and 35 for security purposes, by passing the locking bar of the padlock through the hole 31 to prevent outward pivoting movement of the tail portion of the yoke 22, and thus retaining the detents 25, 26 in locking engagement with the stringers 34, 35.

The pull 21 has a handle portion 47, two side bar portions 48, 49 and a cross bar portion 26. The cross bar 26 extends between the side bars 48 and 49 of the pull 21, and is disposed between the top wing 27 of the slider body 20 and a cam shaped surface 50 of the bottom portion of the yoke 22.

Figure 2:
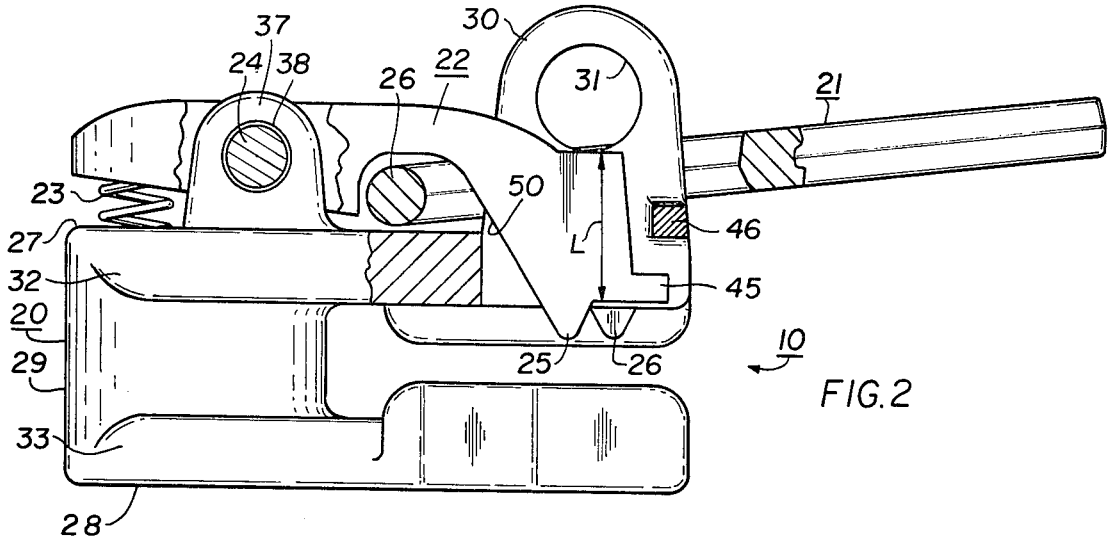
FIG. 2 shows a partially cut-away side perspective view of the slider of FIG. 1.
Figure 3:
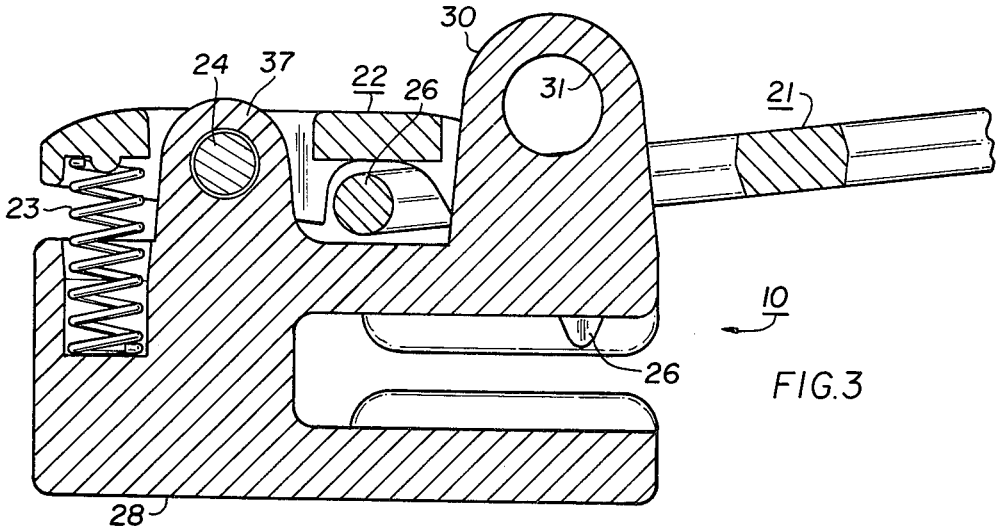
FIG. 3 shows a cross sectional view of the slider of FIG. 1 taken along the cutting plane 3—3 thereof.

When the pull 21 is subjected to an upward or rearward force, i.e. a force in a direction so as to generate a counterclockwise moment about the pivot pin 24, the cross bar 26 bears against the cam shaped surface 50 to cause counterclockwise (as seen in FIG. 2) rotation of the yoke 22 about the pivot pin 24, thus causing the detents or projections 25, 26 to move out of locking engagement with the stringers 34, 35, and permitting movement of the slider 10 in the direction 39 (See FIG. 1).

As previously discussed, when the bar of a padlock or similar device is inserted in the hole 31 of the rear protuberance 33 of the slider body 20, counterclockwise rotational movement of the yoke 22 about the pivot pin 24 is prevented, thus retaining the detents 25, 26 in security locking engagement with the stringers 34, 35.

Thus, by means of a novel and economically practicable structure, there has been provided a slider which, when not locked with a padlock or similar device, may be utilized as an automatically locking slider (i.e., may be positioned and automatically locked at any desired point along the path of the stringers 34, 35); and which, when locking for security purposes is desired, may be simply and readily locked in any desired position by means of a padlock the bar of which is inserted through the hole 31.

While a preferred embodiment of the invention has been described, other embodiments of the invention will be apparent to those skilled in the art. For example, the spring 23 may be replaced by spring means which is integral with the yoke 22. Also, instead of utilizing a spring 23 exerting an upward force, a spring which exerts a downward force may be disposed on the opposite side of the pivot pin 24, to produce the same result.

What is claimed is:

1. An automatically locking security slider for use in a slide fastener including a pair of stringers having mutually interengageable rows of teeth, said slider serving to engage and disengage the same, comprising:

a slider body having a fastener portion for engaging said stringers when said body is pulled in one direction, and for disengaging said stringers when said body is pulled in the opposite direction;

said slider body having first and second protuberances extending therefrom, said protuberances being longitudinally spaced apart on said body in the direction of movement thereof, each of said protuberances having an aperture therein extending in a line transverse to said direction of movement;

a yoke disposed adjacent said slide body, said yoke having a bifurcated end part with the bifurcations thereof disposed on opposite sides of said second protuberance;

a transverse pivot pin passing through the aperture of said first protuberance to rotatably mount said yoke to said slider body at said first protuberance;

spring means for urging said end part of said yoke into said slider body, said end part having a tooth-engaging locking projection on each bifurcation thereof so that when urged against said stringers by said spring means, said projections engage the teeth of respective ones of said stringers to prevent said slider body from moving with respect thereto, a pull for said slider body, said pull having a transverse crossbar member at least partially extending between said yoke and said slider body between said protuberances, so that when a pulling force is applied to said pull said crossbar member moves against said yoke to cause said yoke to rotate about said pivot pin against the urging of said spring means, moving said projections out of locking engagement with said teeth of said stringers and permitting movement of said slider with respect to said stringers, said end part of said yoke disposed in such relationship to said aperture of said second protuberance so that a padlock or the like having a locking bar passing through said aperture of said second protuberance may restrain said yoke so that movement of the projections thereof out of locking engagement with the teeth of said stringers is thereby prevented.

2. The slider according to claim 1, wherein said protuberances are an integral part of said slider body.

3. The slider according to claim 1, wherein said spring means is disposed between said yoke and said slider body.

* * * * *

UNITED STATES PATENT OFFICE

CERTIFICATE OF CORRECTION

Patent No. 4,069,555 Dated January 24, 1978

Inventor(s) Werner Toepelt

It is certified that error appears in the above-identified patent and that said Letters Patent are hereby corrected as shown below:

In the Title Page and at the top of Column 1: The title of the patent should read --AUTOMATICALLY LOCKING SECURITY SLIDER--.

Column 3, line 53: "dispoed" should read --disposed--.

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*